United States Patent [19]

Reed

[11] 4,161,940

[45] Jul. 24, 1979

[54] TELESCOPIC HEAT CONTROL DEFLECTOR

[76] Inventor: Frances E. Reed, 11 N. Shore Trail, Sparta, N.J. 07871

[21] Appl. No.: 753,355

[22] Filed: Mar. 3, 1977

[51] Int. Cl.[2] ..... F24C 1/16

[52] U.S. Cl. ..... 126/59; 126/217; 98/66 A

[58] Field of Search ..... 126/59.5, 211, 217, 126/214, 299, 159; 98/66 A, 76; 431/328, 329

[56] References Cited

U.S. PATENT DOCUMENTS

| | | | |
|---|---|---|---|
| 1,326,576 | 12/1919 | Clark | 98/76 |
| 2,024,078 | 12/1935 | Thomas | 98/76 |
| 3,382,027 | 5/1968 | Marsh | 431/329 |
| 3,592,181 | 7/1971 | Rohwein | 126/59.5 |

FOREIGN PATENT DOCUMENTS

| | | | |
|---|---|---|---|
| 823857 | 9/1969 | Canada | 98/66 A |
| 43614 | 1/1931 | Denmark | 98/76 |
| 819749 | 11/1951 | Fed. Rep. of Germany | 126/59.5 |
| 92185 | 9/1959 | Netherlands | 126/59.5 |

*Primary Examiner*—Carroll B. Dority, Jr.

[57] ABSTRACT

The prime objective of this invention is to direct and control the heat produced on the top of any portable heater measuring on the top 6 to 12 inches in diameter and using gasoline, kerosene and propane gas.

Heat is directed up to 180 degrees by the use of a centrally perforated base flange and two side flanges that move in and away from the base flange. When the flanges are attached to the heater in the handle holes normally provided by the manufacturer a unique tunnel effect is created and moves up and down as required and the holes in the center of the base flange allow proper air circulation resulting in efficiency and effective heat pattern.

10 Claims, 6 Drawing Figures

TELESCOPIC HEAT CONTROL DEFLECTOR

DETAILED DESCRIPTION

Figure 1:
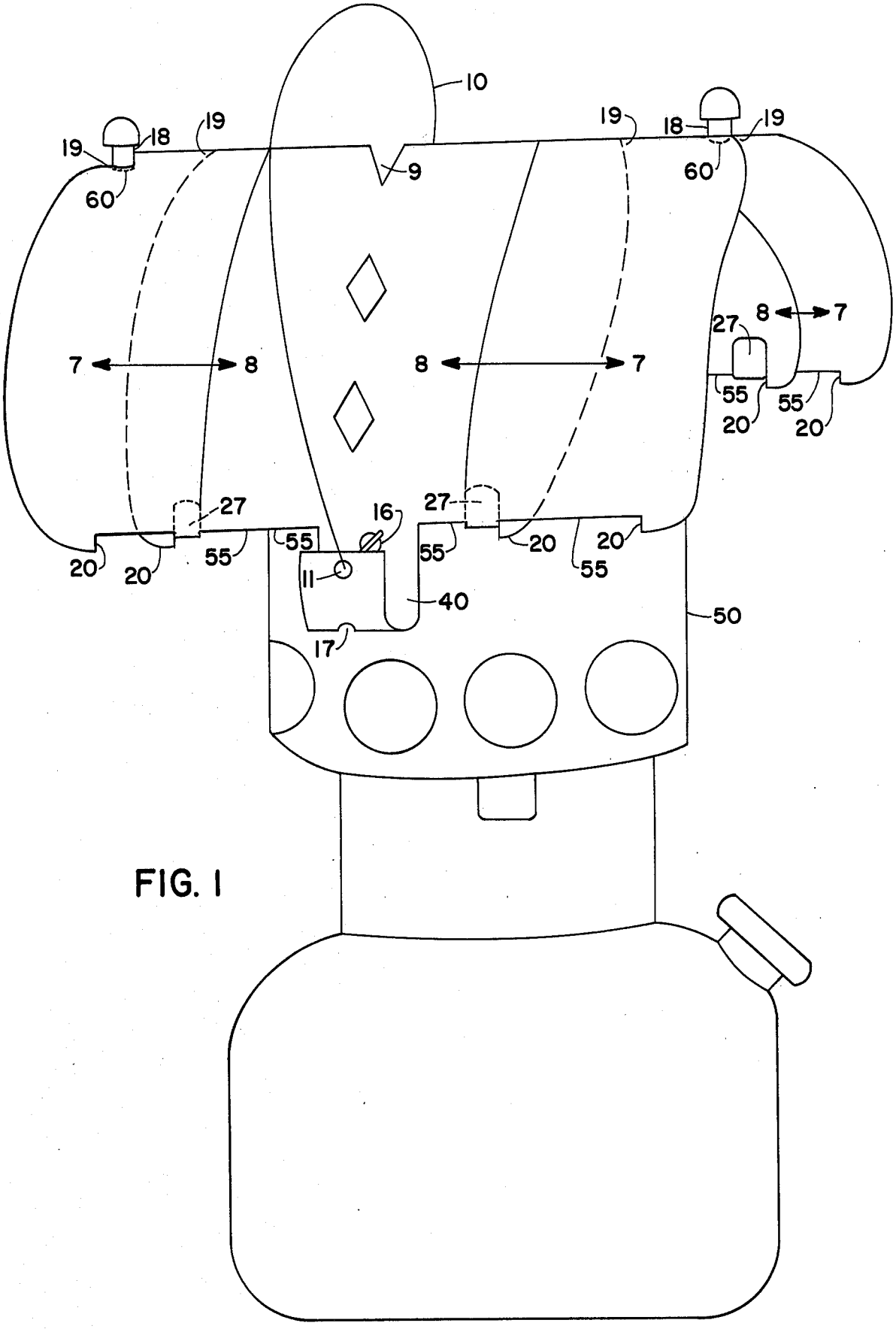
FIG. 1: Shows the heat deflector extended fully in a horizontal position operating on a portable heater.

This invention is made of rustproof material such as stainless steel or galvanized metal with a thickness gauge that will allow for easy cutting and bending.

The metal is cut in such a manner as to make up a basic flange (FIG. 6) nine and a quarter inches by twelve inches having two mounting arms 40 two inches by four inches extending vertical from the basic flange or sheet element 8.

Diamond shaped ventilation through-space or plurality of lineally positioned consecutive openings in series with one-another as holes 9 are cut vertically (upwardly) substantially directly above (see FIG. 1) the heater 50 which is the primary heat source, as extending through 8 allowing hot air to move out and fresh air to move in and be heated by heater 50. The ventilation through-space or holes 9 are, as shown in FIG. 2, located at a point located substantially in alignment between the opposite side edges at which the mounting arms are found.

Two side flanges or telescopable deflector flange sheets 7 are attached to 8 at opposite edges thereof by two metal flaps 27 by bending them over and under 8 stabilizing them against small metal catches 20 which acts as a stop when side flanges 7 are extending fully (FIG. 1). The base flange or sheet element 8 in a direction along the series of holes 9, is arch-shaped in the embodiment shown in FIGS. 1 and 3.

Figure 2:
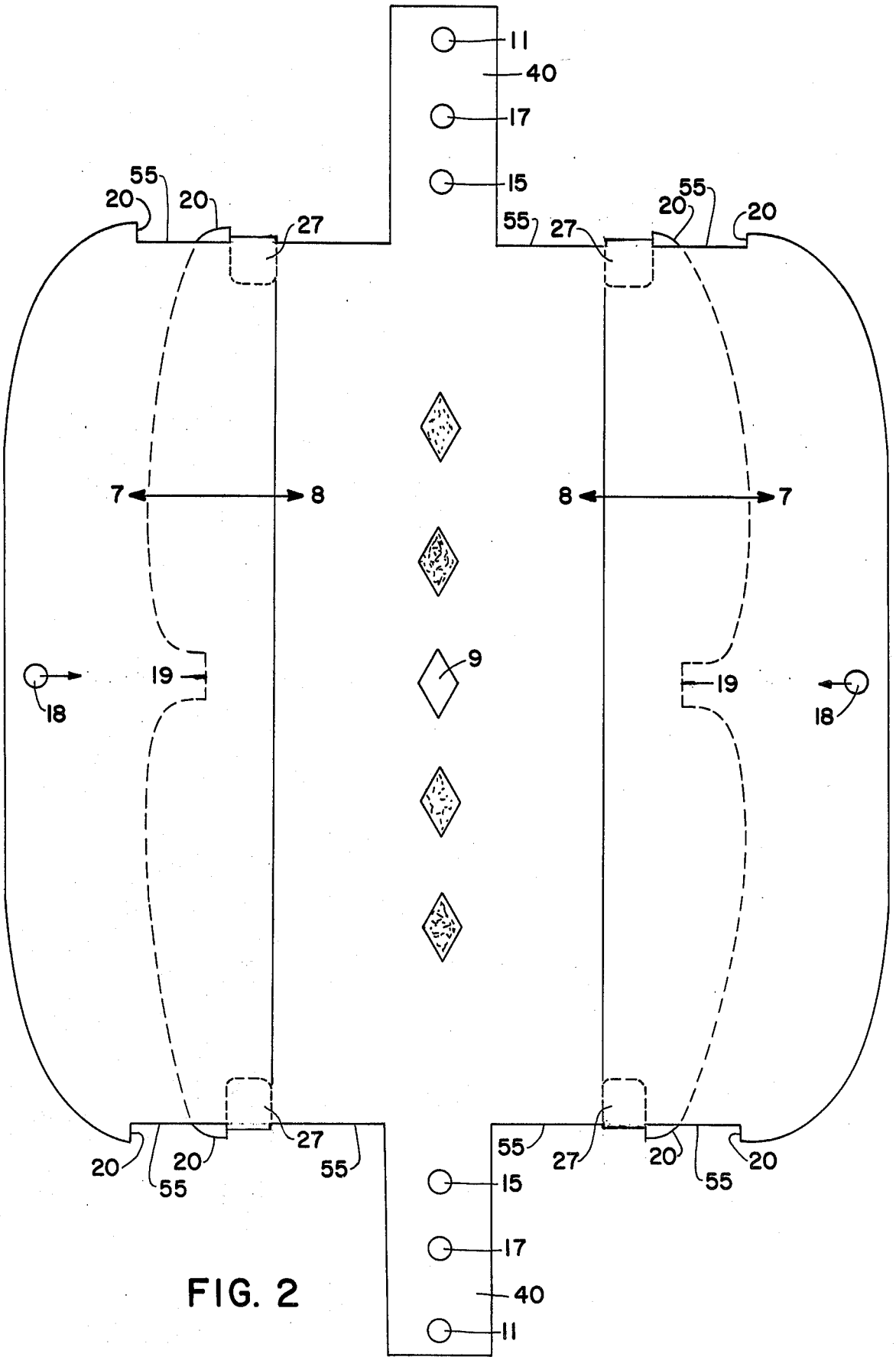
FIG. 2: The heat deflector is shown in a flat, "not in use" position, fully opened and reveals the side flanges can be moved or stored in the base flange and depicts the dotted line the outer shape of the under carriage base flange allowing an indented center cutaway which allows complete enveloping by making room for the metal screw that holds the flange handle.

In FIG. 2 the folding flaps are shown before bending under edge 55.

Handles 18 (FIG. 1 and 2) are used for closing and opening side flanges.

FIGS. 1 and 2 show how handles 18 fit into cutaway 19. Cutaway 19 is so positioned so screwhead 60 in bottom of flange 7 holding handle 18 will snug into the base flange 8 making 7 fit into 8 when desired.

FIG. 1 and FIG. 2 show flanges 7 slide into base flange 8 when not in use allowing storage out of the way on base flange 8. As is shown in FIG. 2 in the fully-extended position, and in FIG. 1 also, the two side flange 7 are slidably extendable and retractable by virtue of the turned-under metal flaps 27 (FIG. 3) as slidable along edges 55 of the sheet element or basic flange 8, slidable in directions shown by the arrows.

FIG. 1 shows the heater handle 10 position in hole 11 located in mounting arm 40.

Figure 4:
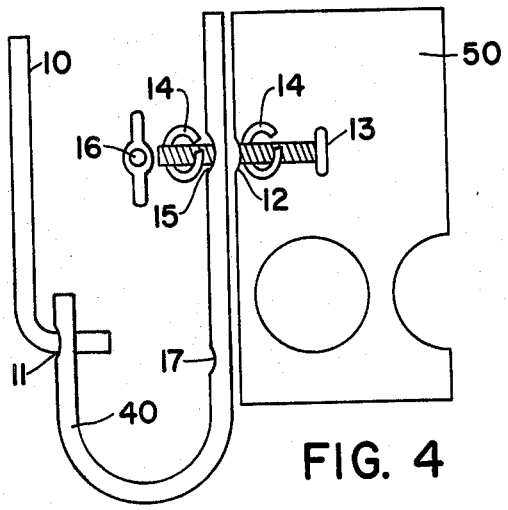
FIG. 4: Shows an exploded side view of the lower or upper arm of the base flange. This shows how the flange is attached to the heater body through the original handle hole.

FIG. 1 shows wing nut 16 in position holding heater male-threaded member or screw 13 in hole 15 as shown FIG. 2 and FIG. 4.

Figure 3:
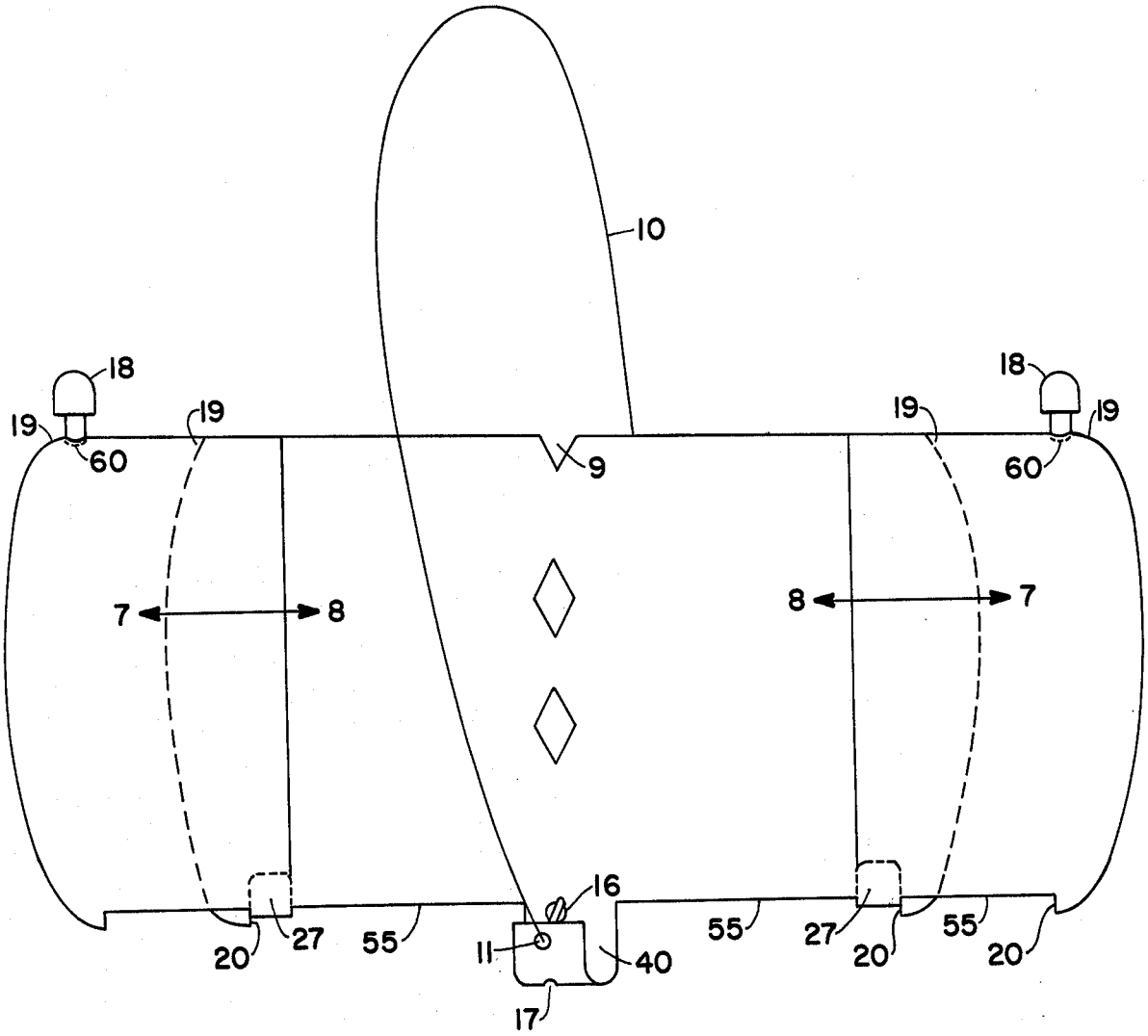
FIG. 3: Shown here with the flange in full operating position is the bottom arm of the base flange bent upward—the heater handle in the bottom hole, the middle hole to be used for attaching to heaters with a twelve inch top and the flange nut holding the deflector in position.
Figure 5:
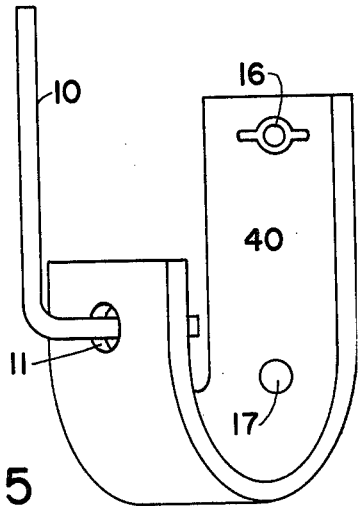
FIG. 5: Shows a partial front view of the upper or lower arm of the base flange as it appears when tightened by the wingnut—and the heater handle in the hole used for attaching same to base flange arm.

Wing nut 16 is tightened by hand on both sides of mounting arms 40 extending from base flange 8. (FIGS. 1, 3, and 5).

The hole 17 in mounting arm 40 (FIGS. 1,2,3,4, and 5) is used for heaters with a top diameter over nine to twelve inches allowing easy and fast installation.

FIG. 4 shows exploded view of arm 40 attached to heater body 50. Metal screw 13 is placed through lockwasher 14, though heater aperture 12, then through hole 15 in arm 40 then through lockwasher 14. Wingnut 16 is shown ready to be placed on bolt 13.

When the wing nut 16 is tightened by hand on both arms 40 the entire heat control is ready for use and tightness of wing nut 16 allows heat deflector to stay any alternate pivoted in position up to 180 degrees, as pivoted on bolt (screw) 13 as shown if FIGS. 1 and 4. Inside and outside use of lockwashers 14 makes this possible.

Figure 6:
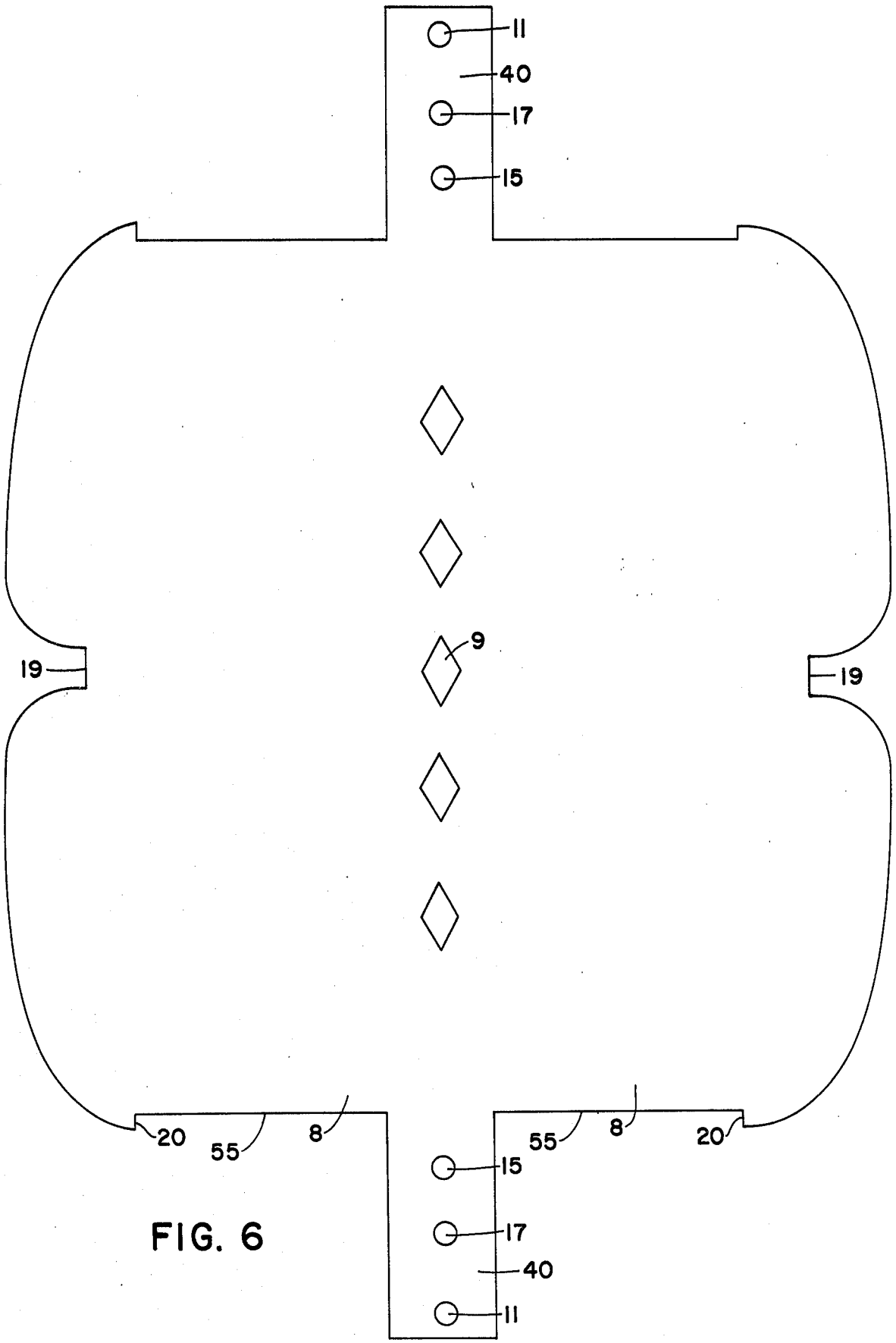
FIG. 6: Depicts the diamond shaped ventilating holes in the base flange with the heat circulating upward. This is a skeleton view of base flange 8 showing a unique design that allows all the new and interesting features to work properly indefinitely.

FIG. 6 shows basic flange 8 the inside appearance controlling a unique pattern of action making the invention an absolute necessity in conjunction with all gasoline, kerosene and propane heaters with top diameters up to 12 inches.

It is, of course, understood that various changes and modifications may be made in the details of construction and design of the above specifically described embodiment of this invention without departing from the spirit thereof, such changes and modifications being restricted only by the scope of the following claims.

I claim:

1. A heater heat-deflector comprising incombination: a sheet element having heater unit-mounting means located at each of two of first opposite side-edges thereof, the heater unit-mounting means being adapted for mounting one of the first opposite side edges onto one side portion of a heater unit, and for mounting a remaining one of the first opposite side edges on an opposite side of the heater unit, such that the sheet element extends above and a predetermined distance above the heater unit sufficiently to deflect rising heat; said sheet element having ventilation through-space extending upwardly through the sheet element at at-least one point located substantially in alignment between said one and said remaining one of said first opposite side edges at a point adapted to be over the heater unit and at-least one telescopable deflector flange-sheet mounted on and extendable from and retractable to at-least one of said other second opposite edges, and being telescopable in to and fro directions.

2. A heater heat-deflector of claim 1, in which said ventilation through-space comprises a plurality of substantially lineally positioned consecutive openings substantially in series with one-another.

3. A heater heat-deflector of claim 2, in which said plurality are located spaced-away from other second opposite edges located at opposite ends of an imaginary axis extending substantially transversely to said lineally positioned consecutive openings, a distance such that the ventilation through-space is located substantially directly above a primary heat source of the heater unit.

4. A heater heat-deflector of claim 3, including separate ones of said telescopable flange-sheets mounted on each of said other second opposite edges.

5. A heater heat-deflector of claim 4, in which said sheet element along a direction extending between said one and said remaining one of said first opposite side edges, is arch-shaped.

6. A heater heat-deflector of claim 5, in which said heater unit-mounting means is detachably mountable on a heater unit and includes apertures through said sheet element adapted to receive a male member therethrough such that the sheet element is pivotable thereon to and fro.

7. A heater heat-deflector of claim 6, including a handle having one end thereof mounted within one of said apertures at said one of said first opposite side edges, and having the remaining opposite other end mounted within said apertures at said remaining one of said first opposite side edges.

8. A heater heat-deflector of claim 6, including said male member and having male-threads thereon, and including a female-threaded member threadably mountable onto said male member adapted to intermittently secure said sheet element in any of desired pivoted alternate positions.

9. A heater heat-deflector of claim 1, in which said heater unit-mounting means is detachably mountable onto a heater unit and includes apertures through said sheet element adapted to receive a male member therethrough such that the sheet element is pivotable thereon to and fro.

10. A heater heat-deflector of claim 9, including said male member and having male-threads thereon, and including a female-threaded member threadably mountable onto said male member adapted to intermittently secure said sheet element in any of desired pivoted alternate positions.

* * * * *